US011013661B2

(12) United States Patent
Stevens

(10) Patent No.: US 11,013,661 B2
(45) Date of Patent: May 25, 2021

(54) BLISTER PACK AND ITS PRODUCTION

(71) Applicants: Manrex Pty., Ltd., Leichardt (AU); Gerard Stevens, Huntleys Point (AU)

(72) Inventor: Gerard Stevens, Huntleys Point (AU)

(73) Assignee: Manrex Pty. Ltd., Leichhardt (AU)

( * ) Notice: Subject to any disclaimer, the term of this patent is extended or adjusted under 35 U.S.C. 154(b) by 290 days.

(21) Appl. No.: 14/901,693

(22) PCT Filed: Jun. 23, 2014

(86) PCT No.: PCT/AU2014/000644

§ 371 (c)(1),
(2) Date: Dec. 28, 2015

(87) PCT Pub. No.: WO2014/205480

PCT Pub. Date: Dec. 31, 2014

(65) Prior Publication Data

US 2016/0143810 A1 May 26, 2016

(30) Foreign Application Priority Data

Jun. 28, 2013 (AU) ..... 2013902426

(51) Int. Cl.
*A61J 1/03* (2006.01)
*B65B 61/02* (2006.01)
(Continued)

(52) U.S. Cl.
CPC ..... *A61J 1/035* (2013.01); *B65B 61/025* (2013.01); *B65D 75/367* (2013.01); *A61J 7/04* (2013.01);
(Continued)

(58) Field of Classification Search
CPC ..... A61J 1/035; A61J 7/04; A61J 2205/10; A61J 2205/30; B65B 61/025; B65B 57/02;
(Continued)

(56) References Cited

U.S. PATENT DOCUMENTS 3,057,473 A * 10/1962 Stern ..... A61J 7/04 116/308
3,756,384 A * 9/1973 Stone ..... B65D 5/4233 206/534
(Continued)

FOREIGN PATENT DOCUMENTS

CA 2498920 A1 4/2006
NO 2013/016757 A1 2/2013
(Continued)

OTHER PUBLICATIONS

Australian Patent Office; International Search Report issued in application No. PCT/AU2014/000644; dated Aug. 5, 2014; Woden Act, Australia.
(Continued)

*Primary Examiner* — Andrew D Perreault
(74) *Attorney, Agent, or Firm* — Chernoff, Vilhauer, McClung & Stenzel, LLP

(57) ABSTRACT

A protected blister package assembled by a pharmacist for a patient has the correctness of its assembly confirmed by checking the correct correlation of three binary codes respectively appearing on three components of the package. The first component comprises a blister sheet loaded with the prescribed medication doses; the second component comprises a backing sheet sealing the medication doses in the cavities of the package blisters; and the third component comprises a protective card to be folded around the blister package after it has been attached to the card. Prior to assembly of the blister package two of the binary codes are printed on the backing sheet and the third binary code is printed on the card. During assembly of the package a portion of the backing sheet bearing one of its two codes is transferred to a predetermined position on the blister sheet. After assembly of the protected blister package the three binary codes are scanned to confirm that the package has been correctly assembled.

15 Claims, 5 Drawing Sheets

(51) Int. Cl.
*B65D 75/36* (2006.01)
*A61J 7/04* (2006.01)
*B65B 57/02* (2006.01)

(52) U.S. Cl.
CPC ..... *A61J 2205/10* (2013.01); *A61J 2205/30* (2013.01); *B65B 57/02* (2013.01); *B65D 2203/06* (2013.01)

(58) Field of Classification Search
CPC ..... B65D 75/367; B65D 2203/06; B65D 2203/08; B65D 5/4212; B65D 5/522; B65D 5/4204
USPC ..... 206/534
See application file for complete search history.

(56) References Cited

U.S. PATENT DOCUMENTS 5,014,851 A * 5/1991 Wick ..... A61J 1/035 206/461
5,323,907 A * 6/1994 Kalvelage ..... A61J 1/035 206/531
7,779,614 B1 8/2010 McGonagle
7,983,995 B2 7/2011 Murphy et al.
2006/0144739 A1* 7/2006 Tsai ..... A45D 33/006 206/459.5
2008/0110791 A1* 5/2008 Specker ..... B65D 75/327 206/531
2012/0160724 A1* 6/2012 Gelardi ..... B65D 5/4204 206/438

FOREIGN PATENT DOCUMENTS

WO 2005/109948 A2 11/2005
WO 2011/041543 A1 4/2011
WO 2011/095562 A2 8/2011
WO 2012/003528 A1 1/2012
WO 2498920 C 7/2013

OTHER PUBLICATIONS

European Patent Office, European Search Report for European App. No. 14818129.0 dated Feb. 7, 2017, 8 pages.

* cited by examiner

BLISTER PACK AND ITS PRODUCTION

CROSS-REFERENCE TO RELATED APPLICATION

This is a national stage application filed under 35 USC 371 based on International Application No. PCT/AU2014/000644, filed Jun. 28, 2014, and claims priority under 35 USC 119 of Australian Patent Application No. 2013902426 filed Jun. 28, 2013.

BACKGROUND

Technical Field

THIS INVENTION relates to the assembly of a disposable blister pack and is more specifically, although not exclusively, concerned with reducing the risk of a blister pack being incorrectly assembled. Such a blister pack may contain prescribed medication doses for administration to a patient and it is important that errors are not inadvertently made during its assembly as this could result in a patient receiving the wrong medication doses with possibly disastrous consequences.

State of the Art

A disposable protected blister pack basically is assembled from three components described below and referred to hereafter as the "specified three components".

The first component takes the form of a transparent blister sheet having manually-depressible blisters each containing prescribed medication doses which are sealed in the blisters by the second component.

The second component comprises a frangible backing sheet in adherent contact with the face of the blister sheet opposite to that from which the blisters extend. It is designed to be easily ruptured by the medication doses in a blister when the blister is manually depressed by the fingers of the patient. The medication doses within each blister are identified by printing on the exposed face of the backing sheet behind it.

The third component is a protective card which is securely attached to the blister pack and is folded around it when not in use to protect it from damage.

The second and third components each have information printed on them identifying a patient for whom the blister pack is intended and the prescribed medication doses contained in the blisters of the pack. Nevertheless it is still possible for a person charged with the responsibility of assembling the blister pack to inadvertently make an error resulting in a patient receiving medication doses from a pack intended for someone else. The risk of such errors occurring increases when the person is loading more than one blister sheet at a time or is otherwise distracted during the loading process.

Object of the Invention

An object of the invention IS to reduce the risk of errors occurring during assembly of a blister pack.

Brief Description of the Invention

In accordance with a first aspect of this invention a method of assembling a blister pack having the specified three components mentioned above, includes the steps of transferring to a predetermined position on the first component one of two unique markings provided on the second component, loading prescribed medication doses into the mouths of the blisters of the first component, sealing the blisters by means of the second component, attaching the sealed blister sheet to a predetermined position on the third component, and finally confirming that the pack has been correctly assembled by correlating the respective markings on the three components with one another.

In accordance with a second aspect of the invention a disposable and protected blister pack comprising: a first component in the form of blister sheet; a second component in the form of a backing strip having a window and adhering to the back of the blister sheet to seal prescribed medication doses within its cavities; a third component in the form of a protective card provided with fold lines and attached to one marginal edge of the blister sheet; markings on all three components which identify the patient and prescribed medication doses contained in the cavities of the blister, the markings on the first component being framed in the window of the second component; and, one fold line on the card providing a hinge about which the pack can be turned to facilitate access to its upper and lower surfaces and thus the removal of medication doses from a selected blister of the pack.

The invention reduces the risk of a disposable blister pack being assembled from components intended for different patients.

Preferred Features of the Invention

The markings may take different forms. However the preferred form of marking is a binary code rather than a unique shape or pattern. Suitably the same binary code is used for all three markings although this is not essential as it is the relationship of the markings to one another which determines whether the protected blister pack has been correctly assembled. The marking common to all three components is conveniently that used to control apparatus for loading the blister cavities with the prescribed medication doses and for identifying the patient for whom the blister pack is intended.

A preferable way of arranging for the transfer of one of the two markings on the second component to the first component is to have it printed on an adhesive tab on the second component. The adhesive tab can then be transferred to a predetermined or designated position on the first component prior to its blisters being loaded with the prescribed medication doses. The location of the adhesive tab at the predetermined position on the first component also positions its marking. As the precise positions of the three markings is known, they can be identified easily by a suitable device such as a binary code reader, and to use the code reader too generate a signal which gives the operator a signal to indicate that the protected blister package has been correctly assembled.

In one arrangement of the invention the marking which is retained on the second component is positioned above the window framing the marking on the tab when attached at a designated to the first component. As long as the second component is correctly attached to the first component, the marking on the tab will appear in the window.

Images of sets of blocks may be provided adjacent the markings on the first and second components so that the block images will register with one another only if the second component is correctly positioned on the first component. Sideways misalignment of the images of the blocks indicates a sideways misalignment of the second component with respect to the first component, and a misalignment in a perpendicular direction is indicated by a foreshortening of the block images or by the complete disappearance of one set of blocks from the window.

It is convenient to arrange for the marking placed on the third component to be located at a position which enables the markings on all three components to lie in a common plane when the sealed pack is turned about the fold hinge. They can then be correlated with one another by a code reader in a single operation.

The invention will now be described in more detail, by way of example, with reference to the accompanying informal drawings, in which:

DETAILED DESCRIPTION OF EMBODIMENTS

Figure 1:
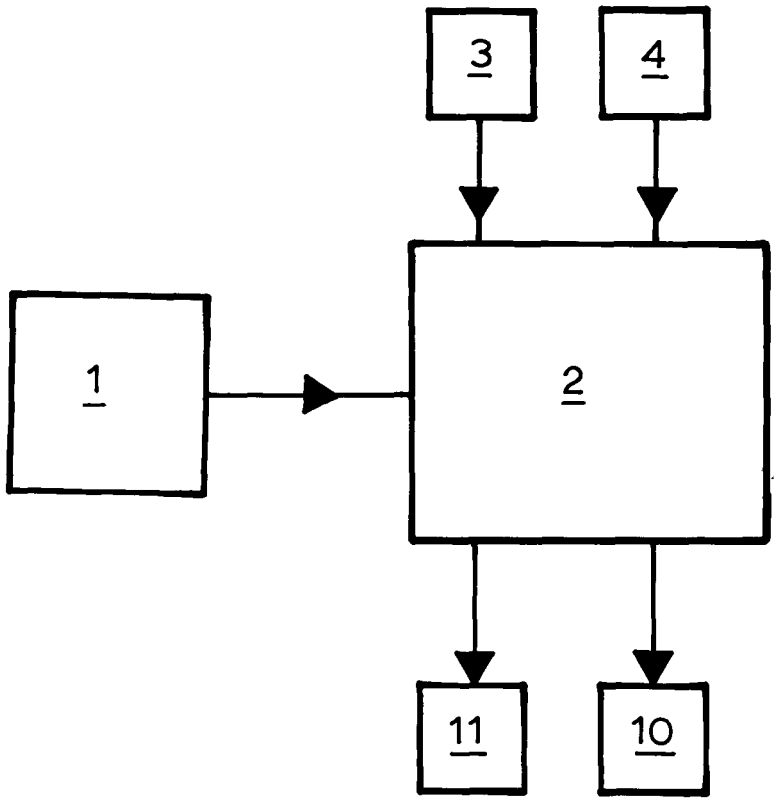
FIG. 1 is a block flow diagram of printing equipment used to provide marking on protective cards and backing sheets.
Figure 3:
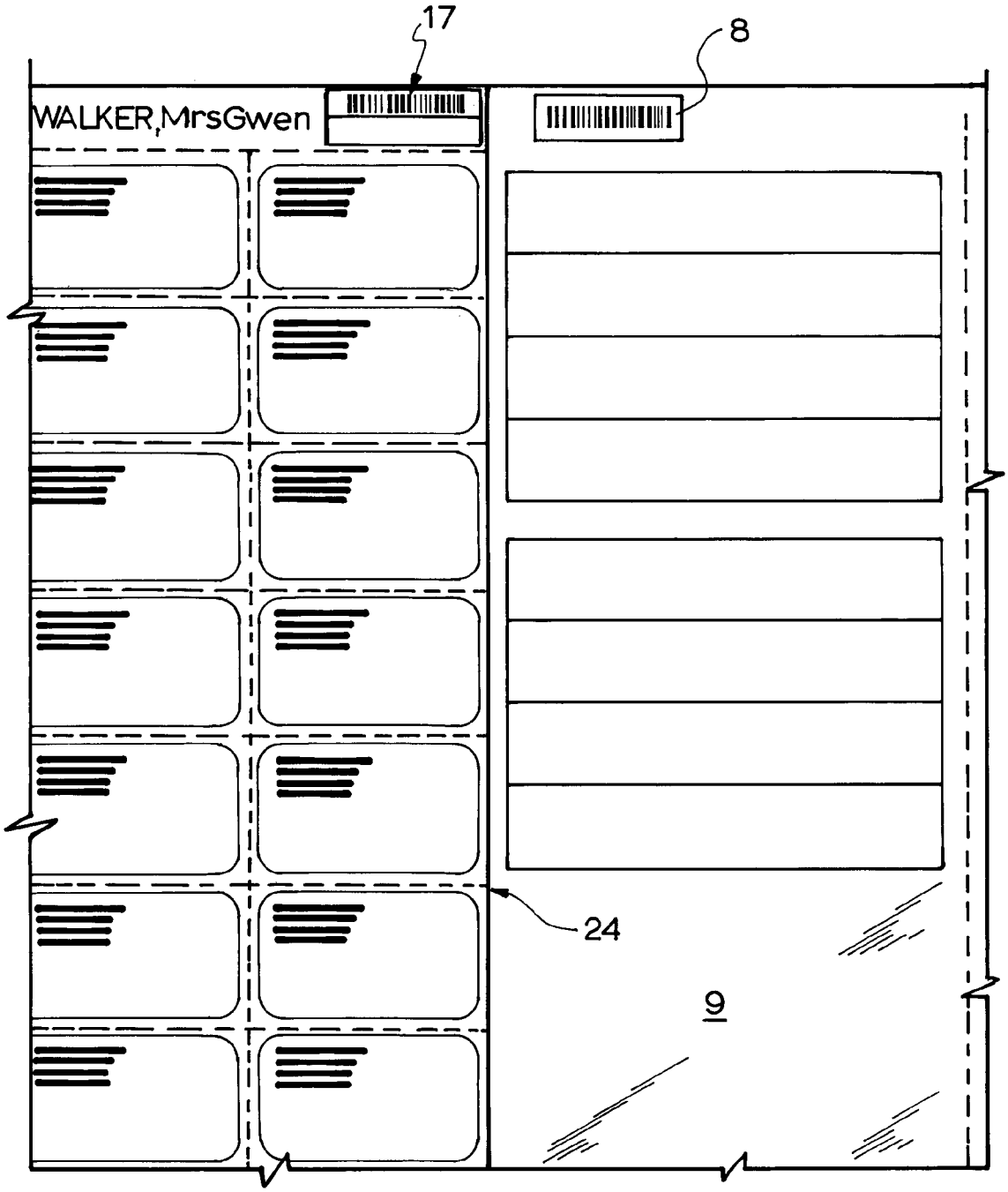
FIG. 3 is a plan view of the underside of a blister pack attached to the protective card forming a third component of the package and shown prior to the card being folded to provide a protective enclosure around the blister pack.

Referring to FIG. 1, a keyboard 1 or other device is used to provide a combined computer and printer 2 with information encoded in a binary form and relating to information concerning the identity of a particular patient and the prescribed medication doses to be administered to him or her. The printer 2 is connected to a first store 3 containing a supply of blank protective cards and to a second store 4 containing a supply of blank frangible backing strips 7 that have their undersides coated with an adhesive layer protected by a removable cover slip (not shown). The printer 2 has two printing heads only one of which is shown, one of the printing heads being used to print identical binary code markings 17 in two separate places respectively provided on one of the blank backing strips 7 provided by the store 4. The second printing head is used to print the same binary code 8 on a protective card 9 provided by the store 3, as shown in FIG. 3. The printed backing strip 7 and the printed card 9 are respectively delivered by the printer to stations 10 and 11. The printer 2 also operates to provide on the backing strip 7 and the card 9 identical binary codes which contain all of the additional visual and other information relating the patient's identity and the nature and quantity of the prescribed medication doses to be administered.

Figure 2:
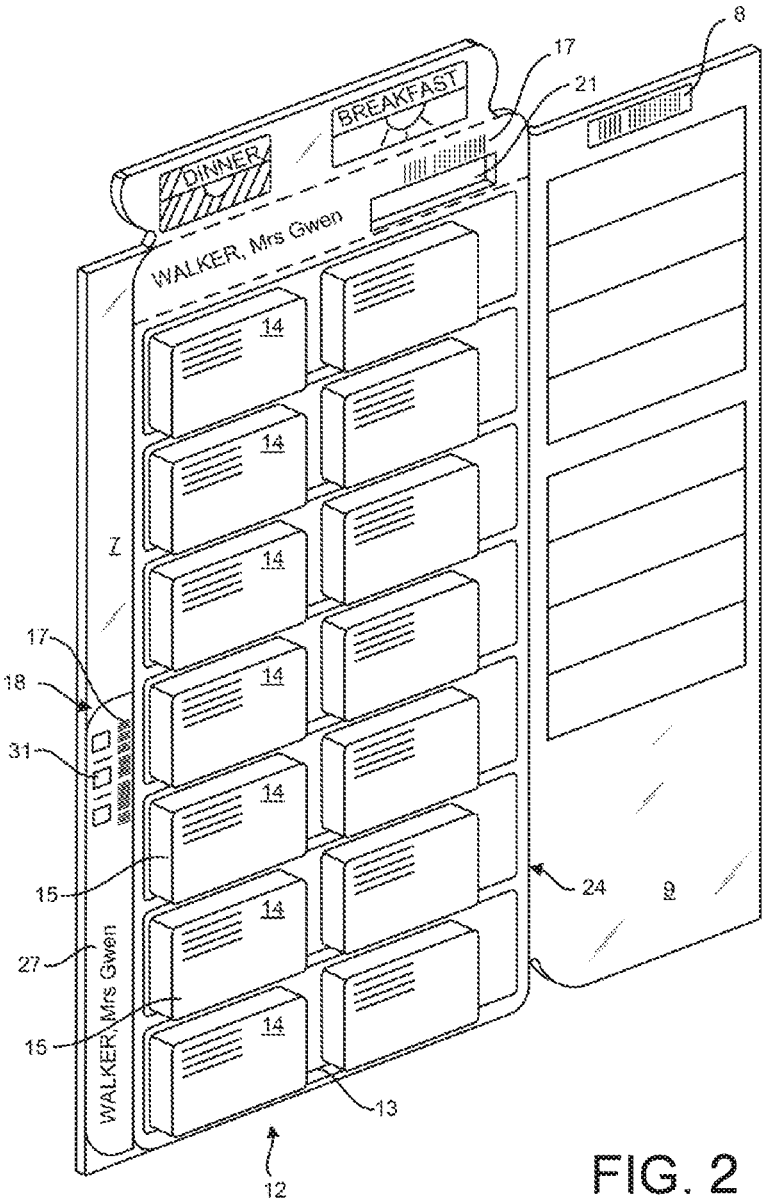
FIG. 2 is a perspective view of a blister sheet, backing strip and protective card forming the blister pack.

FIG. 2 shows the blister sheet, backing strip and protective card. In this example the backing strip has had printed on it two parallel columns 12 and 13 each containing seven zones 14 of printing, each zone being positioned on the backing strip 7 to overlie one of the cavities of a transparent blister sheet as indicated in outline at 15 and providing the first component of the blister package. The printing on each of the zones denotes the nature and quantity of the prescription doses contained in the cavity of the blister beneath.

The two positions at which the binary code markings 17 are printed on the backing strip 7 are, respectively, immediately above a rectangular window 21 and, on a tab 27 adhering to one marginal edge portion 18 of the backing strip 7. The tab 27 has an adhesive backing and can be manually detached from the underlying marginal edge portion 18 of the backing strip 7 and transferred to a designated position (not shown) on the blister sheet at which the code marking 17 on the tab 27 is visible in the window 21 of the backing strip 7 when the backing strip is correctly arranged to seal the prescribed medication doses in the blisters of the cavities beneath.

As shown in FIGS. 2 and 3 the third binary code marking 8 is printed on the protective card 9 close to the line of attachment 24 of the sealed blister pack to the card 9. The line of attachment 24 is denoted on the card 9 by one of five parallel fold lines and provides a hinge about which the blister pack can be turned to the position illustrated and at which it overlies the left-hand portion of the card 9. The binary code markings 8 and the two binary code markings 17 are then located close to one another and lie approximately in the same horizontal plane. This facilitates their being read simultaneously by a binary code reader (not shown). The line of attachment 24 defines one side of a narrow rectangular area of the card on which is applied an adhesive stripe (not shown). The pack is attached to the card 9 by pressing the left-hand marginal edge portion 18 of the blister pack against the adhesive stripe.

Operation of the Above Example of the Invention

The operator of the equipment types on the keyboard 1 the identification data of the patient and, if necessary, any changes to be made to the data information which is permanently stored in the memory of the computer and printer 2. The backing strip store 4 and the card store 3 then deliver to the printer 2 a blank card 9 and a blank backing strip 7. The printer is operated to print onto the card 9 and the blank backing strip 7 the binary code markings 8 and 17.

The tab 27 is then transferred from the backing strip to a predetermined position on the blister sheet which has been placed, blistered side downwards, on a loading table (not shown) to enable the medication doses prescribed to be dropped into the appropriate cavities of the blisters. The predetermined position for the tab 27 is conveniently provided by a shallow well 29 of the same shape as the tab and moulded out of the blister sheet. With the tab 27 in the predetermined position the code marking 17 on it should be displayed in the window 21 of the backing strip directly beneath the identical code marking 17 printed on the blister sheet.

The loading of medication doses into the blister cavities can be carried out by any one of a number of well-known arrangements for loading blisters and, as these are well-known in the art and do not form part of this invention, they will not be further described in this specification. When loading of the blister cavities has been completed, a cover slip (not shown) protecting the adhesive layer on the underside of the backing strip 7, is stripped off and the backing strip is applied onto the blister sheet and gently pressed down so that the adhesive layer on the underside of the backing strip 7 adheres to the blister sheet. The backing strip should then be held firmly in the desired position to seal the medication doses in the blisters.

If the binary code marking on the blister sheet and displayed in the window 21, is identical to that displayed on the backing strip above the window, the printing on the backing strip will correctly indicate the contents of the blister cavities beneath. Likewise if the identity of these binary code markings is the same as that printed on the card 9 alongside the blister pack, the correct protective card has been used for the blister pack.

Second Example of the Invention

Figure 4:
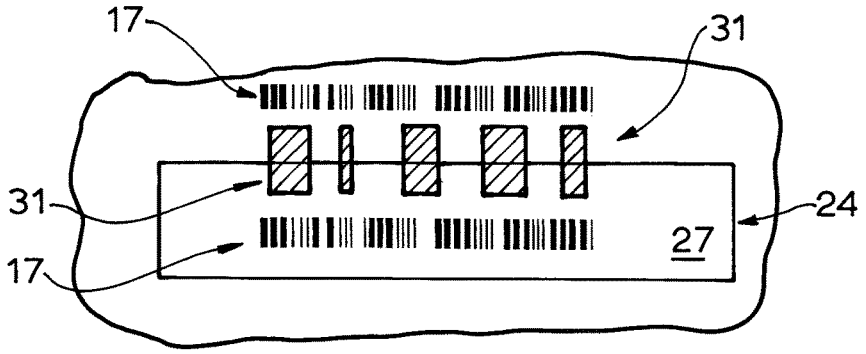
FIGS. 4(A) through 4(D) show how printed sets of blocks can be used in one embodiment of the invention to detect whether an error has occurred in the assembly of the blister pack; and, FIG. 5 is a partially broken-away view of a variation of FIG. 4 designed to enable automatic equipment to be used to check that binary code markings on the three components of the blister package agree with one another to confirm correct assembly of a protected blister package.
Figure 4B:
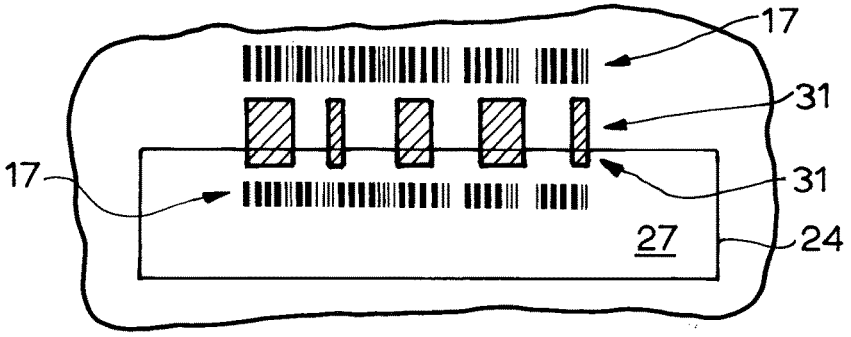
Figure 4C:
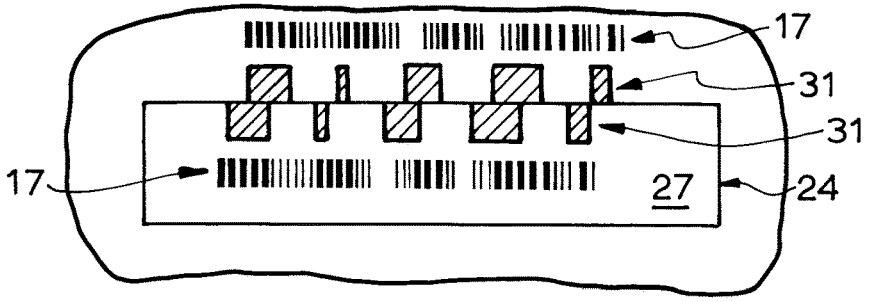
Figure 4D:
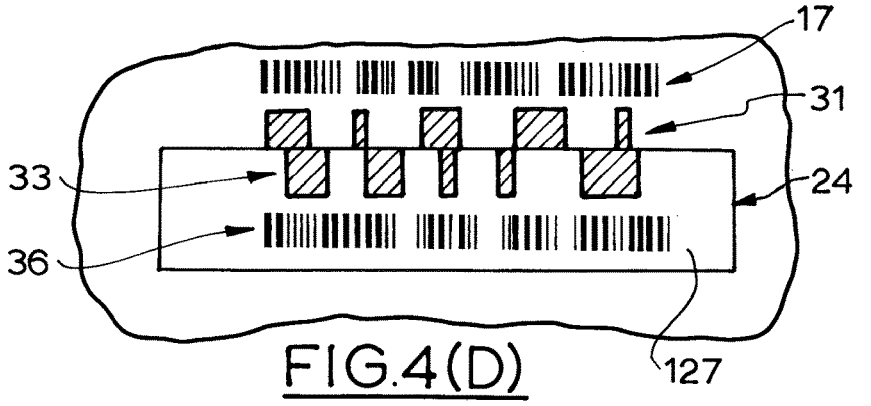

As the reading of binary codes by eye to determine whether they are identical is difficult, the task may be simplified by providing two identical sets 31 of spaced, printed blocks shown in FIG. 4 one set being adjacent the code marking 17 on the tab 27 and the other set being positioned beneath the code marking 17 remaining on the backing strip 7. This is shown in sketch A of FIG. 4. If the blister sheet and backing strip 7 are correctly positioned with respect to one another, the outlines of the blocks will merge as shown in sketch A.

If the blister sheet carrying the tab 27 is misaligned in the direction of the columns 12, 13 with respect to the backing strip 7, the blocks will either be foreshortened in size as represented in sketch B of FIG. 4, or a gap will appear between them if the misalignment is in the reverse direction.

If the blister sheet is misaligned horizontally, for example towards the left as shown in sketch C of FIG. 4, the two sets of blocks will be displaced with respect to one another and the displacement will become immediately visually apparent.

Finally if the blister sheet is carrying a tab 127 which has a code marking 36 different from the code marking 17 appearing above the window 24, the set of blocks 33 will display a different pattern to the set of blocks 31 above the window 24, and this difference will again be visually apparent to the operator as is apparent from sketch D of FIG. 4.

As the binary code markings appear in a common plane for checking, a code scanner can be used to scan all three markings and a light on the scanner used to indicate to the operator whether the markings match one another and whether the backing strip has been correctly applied to the blister sheet.

Figure 5:
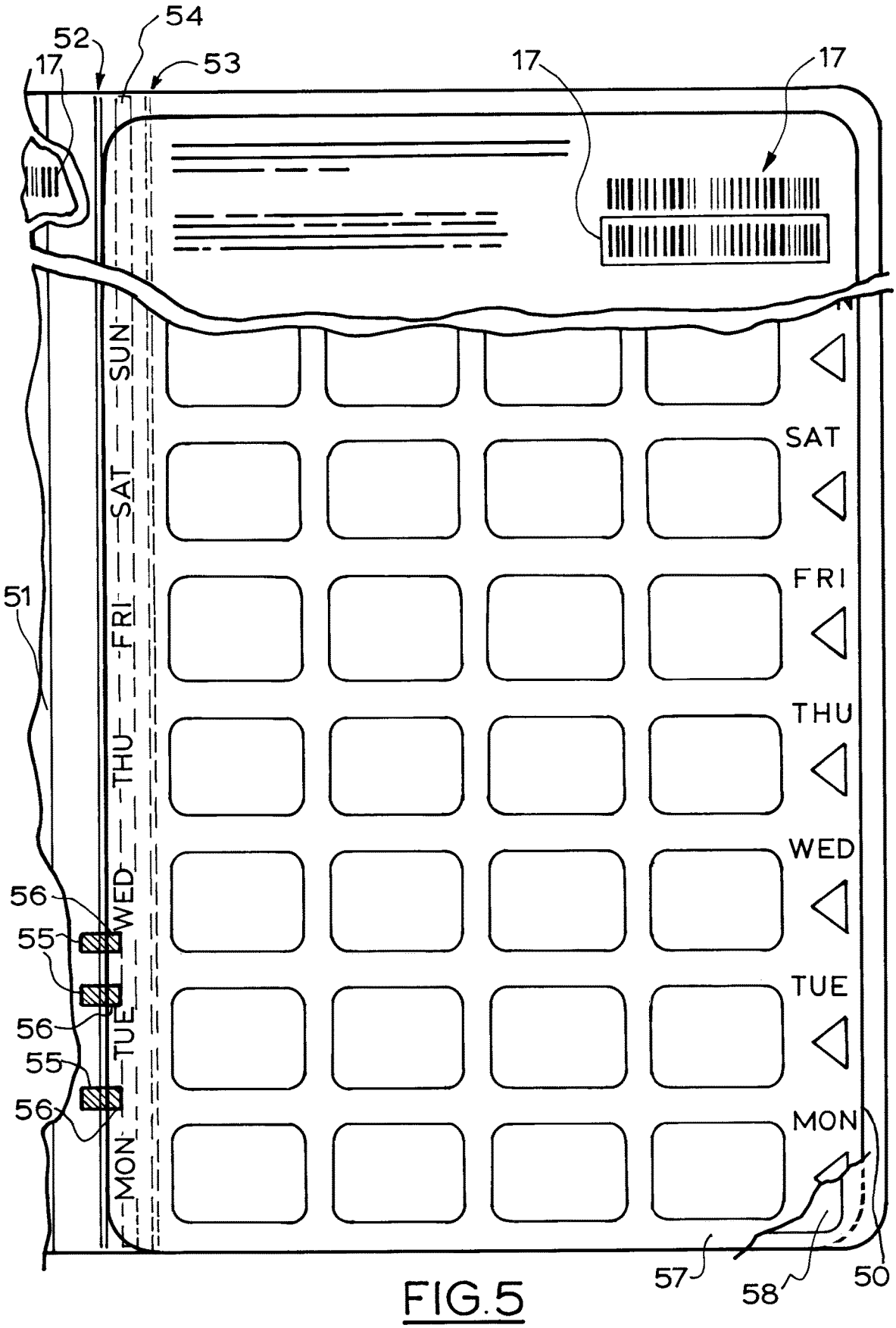

FIG. 5 shows an alternative way of ensuring that the binary codes printed on the three components of the blister package are each positioned in desired locations on the protected blister package when the protective card and attached blister package are laid out flat and the card is placed at a predetermined checking position on the automatic equipment.

FIG. 5 shows a loaded blister package 50 assembled as has previously been described and positioned at a carefully-defined position above a protective card 51 to which it is to be secured. The card is printed with a binary code and other information similar to that on the card of the embodiment shown in FIGS. 1 to 4. The card 51 has two spaced parallel fold lines 52 and 53, which respectively define opposite sides of an elongated rectangular zone 54 coated with an adhesive stripe covered by a manually removable cover slip (not shown).

The card 51 is printed with an unevenly-spaced set of blocks 55 extending alongside the fold line 52, as shown. An identical set of blocks 56 is printed on the marginal portion of a backing strip 57 which has previously been folded around and attached to the marginal edge of a blister sheet forming the second component of the blister package 50.

Correct attachment of the blister package 50 to the card 51 is carried out as follows.

The cover slip protecting the adhesive stripe on the zone 54 is removed and the blister package 51 is inverted so that its blisters extend upwards and the set of blocks 56 are visible extending along its left-hand edge as shown in the scrap view. The set of blocks 56 is aligned with the set of blocks 55 printed on the card 51 and the left hand edge of the card is aligned with the fold line 52. The marginal edge of the blister package is then pressed down firmly on the adhesive stripe on the zone 54 to attach the blister package to the card 51.

The fold line 52 and the alignment of the sets of blocks 55 and 56 ensures that the blister package is located precisely at a carefully defined position so that when the protected blister package is located at the checking position of the checking equipment, the binary codes lie substantially in the same horizontal plane and are approximately aligned with one another so that they can be simultaneously checked for correct correlation. It is then easier to arrange for a signal to be generated by the equipment to indicate to the operator that the protected blister package has been correctly assembled.

From the above description it will be appreciated that the use of the invention reduces the risk of the operator inadvertently assembling the blister package incorrectly or in a way resulting in the patient receiving the wrong prescribed medication.

The invention claimed is:

1. A disposable and protected blister pack, comprising:

a blister sheet which is transparent and which has a plurality of manually depressible blisters protruding on a face of the blister sheet, where each blister defines a cavity capable of containing medication;

a frangible backing strip which seals the cavities of the blisters and which is in adherent contact with a back of the blister sheet located opposite the face, the backing strip having a window, a removeable marginal edge with an adhesive tab, and a first and second marking, the first marking is printed immediately above the window, and the second marking is printed on the adhesive tab, where the tab may be manually detached from the marginal edge;

a protective card securely attached to the blister sheet, the protective card including a third marking and a fold line providing a hinge about which the blister sheet and the backing strip can be turned relative to the protective card to facilitate access to the face and back and thus facilitate the removal of medication from a selected cavity; and wherein the first, second and third markings are all displayed on the same side of the blister pack when the protective card is unfolded, and when the protective card is hinged along the fold line, the third marking is located close to the first marking and is displayed in the window.

2. A blister pack as claimed in claim 1, in which the markings are in the form of binary code.

3. A blister pack as claimed in claim 1 in which the markings include respective sets of blocks which register with one another if the second marking is closely positioned with respect to the first marking.

4. A blister pack as claimed in claim 1 in which the markings respectively provided on the backing strip and protective card are identical and are aligned with one another when the blister sheet is correctly folded with respect to the protective card.

5. A blister pack as claimed in claim 1 wherein the blisters on the blister sheet define a molded shallow well and the adhesive tab on the blister sheet has a second position defined by the shallow well.

6. A blister pack as claimed in claim 5 wherein the adhesive tab is attached to the backing strip in the first position and may be manually transferred from the first position with respect to the backing strip to the second predetermined position on the blister sheet where the first, second and third markings are located close to one another for comparison, and wherein upon pivotally folding the protective card along the fold line, the front of the protective card generally overlies the front of the blister sheet and partially overlies the front of the backing sheet.

7. A blister pack as claimed in claim 1 wherein each of the markings are printed and displayed on the blister pack and each marking identifies a patient and medication prescribed by a medical practitioner.

8. A disposable and protected blister pack, comprising:

a first component defining a blister sheet having a front and a back, where the front defines a plurality of blisters, the blisters each forming a space housing medication, and the back is directly opposed to the front;

a backing sheet having a front and back, a window, a marginal edge with a tab, the front of the backing sheet is selectively adhered to the back of the blister sheet, the front of the backing sheet has a first and second marking, the first marking is printed immediately above the window, and the second marking is printed on the adhesive tab parallel to the marginal edge, where the tab may be manually detached from the marginal edge of the front of the backing sheet; and a protective card having a front and back, the protective card is pivotally connected along a fold line to the blister sheet and backing sheet, and the front of the protective card has a third marking;

wherein upon pivotally folding the protective card along the fold line, the front of the protective card generally overlies the front of the blister sheet and partially overlies the front of the backing sheet, and the third marking is located close to the first marking and is displayed in the window.

9. A blister pack of claim 8, where the tab has an adhesive on the back of the backing sheet and may be selectively detached from the backing sheet.

10. A blister pack of claim 9, wherein the first, second and third markings are identical.

11. A blister pack of claim 10, wherein the first, second and third markings are in binary code.

12. A blister pack of claim 10, wherein the blister sheet is partially transparent.

13. A blister pack of claim 10, wherein the first marking is positioned vertically above the window of the backing sheet.

14. A blister pack of claim 9, wherein the blisters on the blister sheet comprise shallow cavities.

15. A blister pack of claim 10, wherein the first, second and third markings are displayed in blocks.

* * * * *